United States Patent [19]

Libman

[11] 4,392,077

[45] Jul. 5, 1983

[54] DEEPLY FILTERED TELEVISION IMAGE DISPLAY

[75] Inventor: Philomena C. Libman, Mt. Prospect, Ill.

[73] Assignee: Zenith Radio Corporation, Glenview, Ill.

[21] Appl. No.: 11,961

[22] Filed: Feb. 14, 1979

[51] Int. Cl.[3] ..... H01J 29/30

[52] U.S. Cl. ..... 313/474

[58] Field of Search ..... 313/474

[56] References Cited

U.S. PATENT DOCUMENTS

| | | | |
|---|---|---|---|
| 2,599,739 | 6/1952 | Barnes | 313/441 |
| 2,644,854 | 7/1953 | Sziklai | 313/474 |
| 2,750,525 | 6/1956 | Palmer | 313/472 |
| 2,828,435 | 3/1958 | Hoyt | 313/462 |
| 2,858,234 | 10/1958 | Ishler . | |
| 2,913,352 | 11/1959 | Windsor . | |
| 2,931,863 | 10/1960 | Selby et al. . | |
| 2,959,483 | 11/1960 | Kaplan | 313/474 |
| 3,013,114 | 12/1961 | Bridges | 313/474 |
| 3,146,368 | 8/1964 | Fiore et al. | 313/408 |
| 3,454,715 | 7/1969 | Larach et al. | 313/468 |
| 3,544,354 | 12/1970 | Kachel | 313/474 X |
| 3,614,503 | 10/1971 | Dietch | 313/472 |
| 3,812,394 | 5/1974 | Kaplan | 313/474 |
| 3,886,394 | 5/1975 | Lipp | 313/470 |
| 3,952,225 | 4/1976 | Dietch | 313/472 |
| 4,087,280 | 5/1978 | Stookey et al. | 96/27 R |
| 4,132,919 | 1/1979 | Maple | 313/474 X |

FOREIGN PATENT DOCUMENTS

| | | |
|---|---|---|
| 426789 | 6/1935 | United Kingdom . |
| 2013915 | 12/1978 | United Kingdom . |

OTHER PUBLICATIONS

Ikegaki et al., Blackstripe High Contrast Color Picture Tube; Toshiba Review (Japanese Ed.) p. 10; Aug. 1976.

Uehara et al., High Contrast Color Picture Tube; Hitachi Review; vol. 27 (1978) #4; pp. 227–230.

*Primary Examiner*—Alfred E. Smith

[57] ABSTRACT

A low-cost, deeply filtered television imge display is depicted. A viewing screen includes a patterned layer of phosphor particles disposed contiguous to the inner surface of the display. The layer when excited emits light of a predetermined color. The display includes means for exciting selected areas of the layer to produce a luminescent informational image. The image is subject to loss of contrast caused by reflection of ambient light from the layer. The improvement comprises a shallow, random, clumped, discontinuous, open dispersion of contrast-enhancing particles of pigment having a body color corresponding generally to the predetermined color disposed directly on the viewing screen beneath the layer and not significantly admixed with the phosphor particles. The percentage of open area of the dispersion of pigment particles and the absorption characteristics thereof are such that the dispersion efficiently filters ambient light at its interface with the layer. This filtering is accomplished first by absorption of directly incident ambient light, and secondly by absorption of ambient light passing through the open dispersion and scattering back off the phosphor particles to the dispersion. The dispersiion represents a tolerable impediment to image light emitted by the phosphor particles due to the shallowness and openness of the dispersion and its non-absorption of light of said predetermined color. The dispersion negligibly absorbs electron beam energy due to its location beneath the layer. As a result, deep filtration of ambient light and thus high picture contrast is made practicable without a disproportionately countervailing loss in picture brightness.

8 Claims, 13 Drawing Figures

DEEPLY FILTERED TELEVISION IMAGE DISPLAY

BACKGROUND OF THE INVENTION AND PRIOR ART STATEMENT

This invention relates in general to image displays including television cathode ray picture tubes, and more particularly is concerned with improvement in image display contrast by a reduction in the reflection of ambient light from the display faceplate.

It has long been a major goal in the image display art to provide a display having a maximum image contrast together with maximum brightness. Brightness has been enhanced, for example, by utilizing more efficient phosphors and, in cathode ray picture tube displays, by impacting the phosphors with electron beams having increased energy.

Image contrast was enhanced in the earlier days of television by means of a neutral density filter (typically about 42% transmissive) positioned over or incorporated in the viewing faceplate. Ambient light striking the faceplate was subject to a first reduction in its passage through the filter toward the phosphor screen, then to a second reduction as it was reflected back to the viewer, again through the filter. A penalty was paid in the use of this system in that light emitted by the phosphor was also attenuated in its single passage through the filter.

A major breakthrough in enhancing image contrast was achieved through the "black surround" system disclosed by Fiore et al in U.S. Pat. No. 3,146,368. A screen structure is disclosed wherein the phosphor deposits, instead of having tangential contact with one another, are reduced in size and separated over the screen area. A light-absorbing pigment is placed in the spaces between these phosphor deposits. The electron beam landing area is larger at least in the horizontal direction then the phosphor deposits. The black surround structure so markedly increases contrast that the faceplate glass can be made clear and the brightness thereby doubled.

Imaging screens having filter particle elements associated with a phosphor element are intended to provide for reduction in ambient light reflection which more than offsets the inevitable loss in brightness. Filters comprise materials that are transmissive to light of certain wavelengths, but absorptive of light of other wavelengths. As indicated by FIG. 1A, part of the beam 1 of white light falling on an optically continuous filter material 2 will be reflected, as indicated by beam 3, while part of the beam will be transmitted through the material as indicated by beam 4. If the filter material is blue, for example, light of all wavelengths other than blue will be absorbed, and only blue light will be able to pass through the filter material 2, as indicated by beam 4. Also, the reflected light indicated by beam 3 will appear to be blue. Examples of optically continuous filter elements usable in picture screens include the lusters manufactured by Englehard Industries of Newark, N.J.

Pigments can be considered as particulate filters with a high index of refraction. With reference to FIG. 1B, a beam 5 of white light is shown as impinging upon a pigment particle 6. The particle is highly absorptive of light of all wavelengths except those in a selected band, or bands. Light of all other wavelengths is quickly absorbed as it enters the particle 6. Light within the selected band or bands is transmitted or reflected internally, exiting the particle 6 in all directions as shown by arrows 7, giving the pigment particle its characteristic color or hue. In effect, the pigment particle "scatters" light falling upon it. If the particle of pigment comprises a blue pigment, for example, only blue light will be scattered, and light of all other wavelengths will be absorbed. The amount of scattering depends, inter alia, upon the size of the particle, with maximum scattering occurring when the particle is of about the same size as the wavelength of the light impinging upon it. Examples of pigments include titanium dioxide, a white pigment; cobalt, a blue pigment; and cadmium sulfoselenide, a red pigment.

Kaplan in U.S. Pat. No. 2,959,483 discloses a color image reproducer and method of manufacture. One embodiment (see FIG. 2 herein) comprises green, red and blue target elements 10, 12 and 14 which are located between faceplate 16 and aluminum film 18. Each target element comprises two discrete layers: a phosphor layer 20 and a filter layer 22. Layer 20 comprises a specific color phosphor for each target element; for example green phosphor 24 in target element 10. Filter layer 26 in target element 10 comprises a continuous green filter material which selectively transmits light of the wavelength corresponding to the green primary color while sharply attenuating the red and blue primaries. The effect of color filter layer 26 upon three impinging rays of ambient light is illustrated by lines 28, 30 and 32. Line 32 represents light of a wavelength corresponding to green in color, while lines 28 and 30 represent red and blue, respectively. Because of the selective light transmission characteristics of the color filter layer 26, the red and blue light represented by rays 28 and 30 is sharply attenuated in passing through filter material 26 as light of such colors is reflected from the target element. In fact, filter 26 attenuates the impinging light twice, once each time it is required to traverse the filter material. The same effect takes place with regard to the red target element 12 and the blue target element 14. The result is that much if not all of the ambient light impinging upon the target structure is absorbed by the respective filter layers to improve image contrast and color saturation under high-level ambient viewing conditions, and without substantially reducing image brightness.

This approach is feasible because an optically continuous (non-particulate) filter layer will transmit a major fraction of the light having wavelengths within its bandpass. Optically continuous filter materials, as presently known however, are impractical since their deposition methods are too costly for use in mass-production. Because of the expense entailed in their use, optically continuous filters, so far as is known, have never been used commercially in the manufacture of color cathode ray tubes.

Another embodiment of Kaplan '483 teaches the use of mixtures of luminescent materials and pigment-type color filter material having selective color-transmissive characteristics corresponding to the emission characteristics of the associated phosphor. A further embodiment of the '483 disclosure is similar to the discrete phosphor-filter layer system of FIG. 2, except that the luminescent layer comprises a homogenous mixture which emits light in all three of the primary colors selected for image reproduction; i.e. white light.

U.S. Pat. No. 3,886,394 to Lipp discloses an image display employing phosphor particles which are filter-coated. FIG. 3 indicates, according to Lipp, a light-emitting phosphor particle 33, the surface of which is coated with filter particles 33A comprising a pigment which is said to absorb spectral components of light from ambient sources. It is alleged that by only partially covering, in the range of 20 to 80%, the phosphor particles with filter particles, the transmission, absorption and reflection of light may be "tailored" to optimize the brightness and contrast of the display image where the ambient light level is relatively high. Two embodiments are disclosed: one in which there is a single layer of phosphor particles coated as described, and the other consisting of two layers comprising the coated phosphor particles, and over this, a layer of phosphor particles which are uncoated.

Uehara et al, in an article entitled "High Contrast Color Picture Tube" (Hitachi Review, Vol. 27 (1978), No. 4) reviews various filter phosphor screening techniques as follows (quoting directly from the article):

"Phosphor screening processes with pigments are generally classified into the following three kinds depending upon how the pigment is involved in the screen:

(1) Filter preparation process
(2) Slurry mixture process
(3) Pigmented phosphor process "In the filter preparation process, the pigment layer is placed between a glass panel and the ordinary phosphor screen so that it works as a cut-off filter against any colors other than those emitted from the phosphor used. This conception has been known widely since before the black matrix screen was introduced. However the complexity of the process has prevented it from being applied to practical production.

"The slurry mixture process is far easier in the use of pigments, because they are simply mixed into the ordinary phosphor slurry which is very common for screening. In this case, however, it is very difficult to completely avoid so-called pigment cross contamination which usually results in a brightness loss in the finished tube.

"After carefully studying these processes, we concluded that they could not be used for our purpose and a third process should be sought.

"Finally we developed the pigment phosphor process. Blue phosphor was coated with the blue pigment cobalt aluminate, red phosphor with the red pigment ferric oxide."

In an article entitled "Black Stripe High Contrast Color Picture Tube," by Ikegaki et al. (Toshiba Review, August 1976), a "graduated" pigment system is disclosed in which the blue phosphor particles have a pigment coating and in which the concentration of pigment varies through the blue phosphor field, with the heaviest concentration of pigment being nearest the screen. A large increase in contrast over the standard Toshiba black-stripe tube is alleged.

The mixing of filter materials or pigment particles with the phosphor can result in undesired side effects such as cross-contamination. In addition, such mixing can reduce the brightness of the images produced by the associated phosphor particles by shielding the phosphor particles from energizing electrons, and by absorption of the light emitted by the phosphor particles near the point of origin. As will be explained in more detail hereinafter, a pigmented phosphor material can be used to produce a very slightly improved picture if the amount of pigmentation is very modest—e.g., that amount which reduces ambient light reflection, in comparison to one that is not pigmented, in the approximate range of 15% to 20%. Attempts to make a "deep filter" tube or screen using the prior art pigmented phosphor approach resulted in excessive brightness losses. In the context of this application, a "deep filter" screen is considered to be so filtered that a reflectivity reduction of about 35% to 50% is provided with a corresponding higher picture contrast.

Hoyt in U.S. Pat. No. 2,828,435 discloses means for making television screens in cathode ray tubes by a decalcomania process. In one of many illustrative decalcomania embodiments, a backing sheet is surmounted by pigment layer, a phosphor layer, and a protective clear surface layer. The backing sheet is removed, and the assembled layers are applied to the faceplate to form the screen with the pigment layer lying closest to the faceplate. The stated purpose is (quoting) " . . . to slightly shade or color the image of cathode ray tubes."

In U.S. Pat. No. 2,858,234, Ishler discloses a method for coating the inside wall of a fluorescent lamp envelope with a color-subtractive pigment said to have a uniform thickness and freedom from streaking. The pigment, which operates by subtraction or absorption of undesired color to increase the proportion of the desired color in the spectral output is said to achieve a greater intensity or saturation of the desired color of the light emitted by fluorescent illuminating lamps.

Barnes U.S. Pat. No. —2,599,739 discloses the provision of a reflection-reduction coating between the material of the inner face of a cathode ray tube and the fluorescent screen. The coating is alleged to reduce halation by eliminating to a substantial degree the amount of light reflected from the surfaces of the tube face onto the fluorescent screen. The preferred coating is said to be formed of "submicroscopic, microgranular" (sic) discrete approximately spherical particles less than 625 angstroms in diameter which are deposited on the glass surface so as to form minute projecting irregularities on the surface. Further, the concentration of the particles in the irregularities is said to decrease from the surface of the tube face outward, forming angularities which are alleged to increase the transmission of light rays from the surface with a consequent reduction in reflected light rays.

In U.S. Pat. No. 3,614,503 to Dietch, assigned to the assignee of the present invention, a screen is disclosed for a color cathode ray tube comprised of interleaved deposits of phosphor material which emit light of different colors; the deposits are surrounded by a light-absorbing material. A plurality of diffusely reflecting materials is superposed over the phosphor deposits and the light-absorbing material. The reflecting material and the light-absorbing material are spaced with respect to one another to simulate a multiplicity of integrating spheres surrounding the phosphor deposits. It is said that multiple reflections from the surfaces permit light developed by the phosphor dots and otherwise attenuated in the light-absorbing material to be added to the useful light output of the tube.

Dietch in U.S. Pat. No. 3,952,225, assigned to the assignee of the present invention, discloses a cathode ray tube image screen wherein a substantially non-reflective grille is provided on the faceplate. A reflective grille is provided in registration with the non-reflective grille, with a phosphor screenover the reflective grille backed by an aluminum film. Light emitted in the open phosphor areas find its way out directly through the faceplate. However, light emitted by the excited phosphor areas behind the black grille (as seen from the viewing side), instead of being dissipated by the light absorption of the black grille, is subjected to multiple reflections between the reflective grille elements and the aluminum backing layer. This light is said to eventually reach the open phosphor areas whereupon it is also emitted by the faceplate. The invention is said to provide a new and greatly improved high-brightness, high-contrast cathode ray tube image screen for use in either monochrome or color picture tube environments.

OTHER PRIOR ART

Patents:

Pat. No. 426,789—Siemens (German)
U.S. Pat. No. 2,644,854—Sziklai
U.S. Pat. No. 2,750,525—Palmer
U.S. Pat. No. 2,848,233—Yanagisawa et al
U.S. Pat. No. 2,913,352—Windsor
U.S. Pat. No. 3,013,114—Bridges
U.S. Pat. No. 3,454,715—Larach et al
U.S. Pat. No. 3,812,394—Kaplan
U.S. Pat. No. 4,087,280—Stookey et al

OBJECTS OF THE INVENTION

It is a general object of this invention to provide an improved television image display having enhanced picture quality.

It is another general object to provide an image display having enhanced contrast.

It is a less general object to provide an image display which is not limited to shallow filter or medium filter applications wherein the maximum attainable improvement in brightness contrast contrast of a tube is modest, and of questionable effectiveness.

It is a specific object of the invention to provide an improved image display utilizing a color-selective filter as part of the screen which yields an improved picture/brightness contrast factor, particularly in deep filter applications wherein the filter concentration is relatively high and the improvement dramatic.

It is another specific object to provide a filter-type image display capable of providing dramatically improved picture quality comparable to optically continuous filter approaches, but without the cost prohibition associated therewith.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

This invention finds useful application in image displays wherein a phosphor is deposited contiguous to a transparent imaging screen. Deep filtration of ambient light; that is, filtration that provides a reduction in reflection of ambient light of 35% to 50% making possible high picture contrast.

Figure 1A:
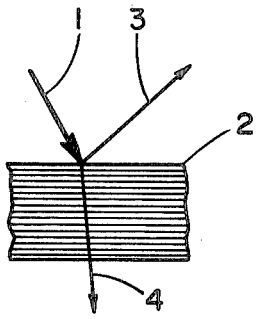
Fig. 1A PRIOR ART
FIGS. 1A and 1B show schematically the effect of a beam of white light falling on an optically continuous filter material and a pigment particle, respectively.
Figure 1B:
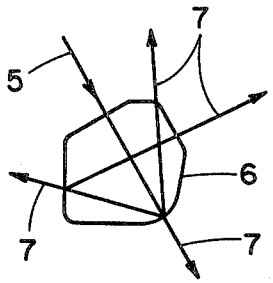
Fig. 1B PRIOR ART
Figure 3:
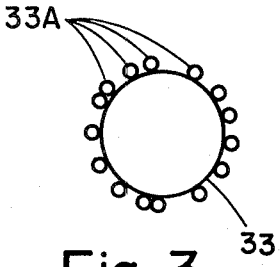
Fig. 3 PRIOR ART
FIG. 3 is an idealized sectional view of a pigment-coated phosphor particle employed in a prior art viewing screen.
Figure 2:
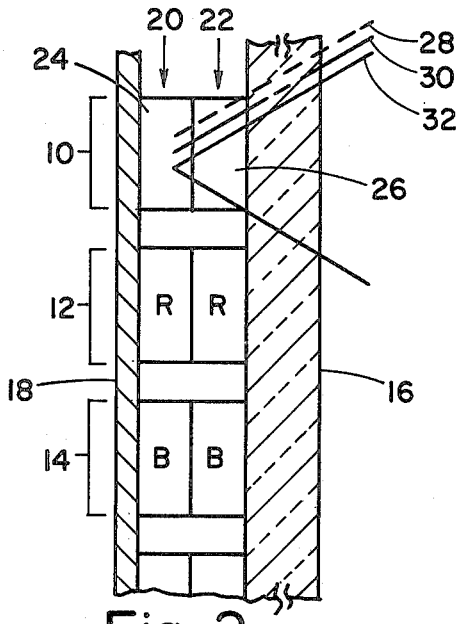
Fig. 2 PRIOR ART
FIG. 2 is an enlarged cross-sectional view of a portion of the imaging screen of a prior art color television image display.
Figure 4A:
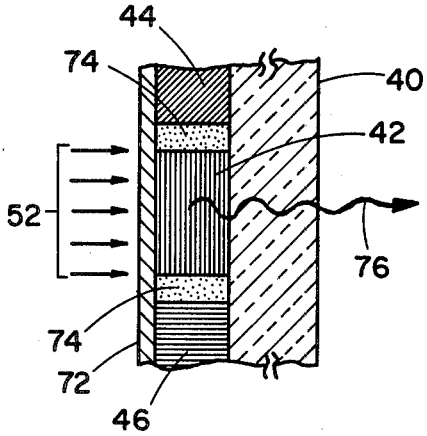
FIG. 4A is an enlarged detail view also in section of a portion of the tube shown by FIG. 4.
Figure 4:
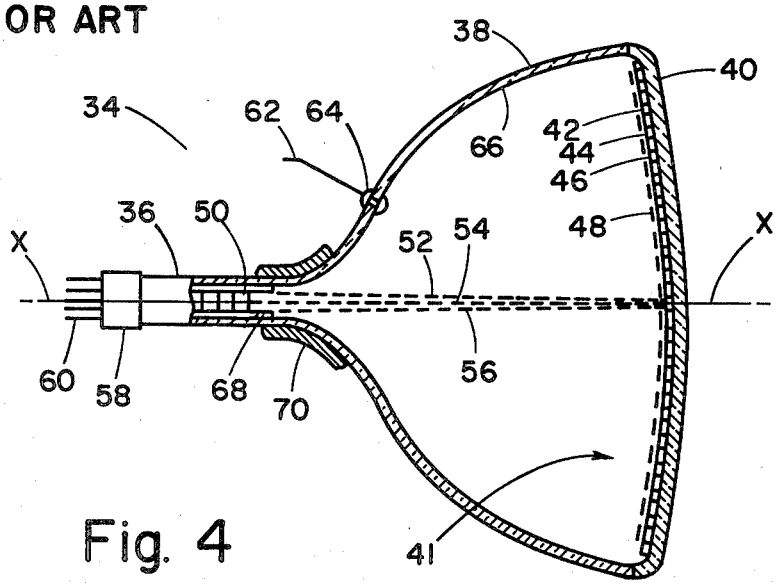
FIG. 4 is a schematic top view in longitudinal cross-section of a prior art color television cathode ray tube image display in which the invention may be advantageously employed.

A well-known example of an image display comprises a multicolor cathode ray picture tube of the aperture mask type, shown by FIG. 4, wherein the invention may be advantageously employed. Primary components of the picture tube 34 comprises an evacuated envelope including a neck 36, a funnel 38 and a faceplate 40 having a viewing screen 41 on its inner surface. A pattern of triads of target elements is deposited contiguous to the screen 41, typified by elements 42, 44 and 46. Each target element of each triad has assigned a layer of one of three types of phosphors emitting, when excited, either red, green or blue light. The display includes ancillary means such as circuits and components (not shown) for selectively exciting ones of said target elements to produce a luminous informational image, as is well-known in the art. The target elements may comprise a dot pattern; alternatively, the pattern may comprise triads of stripes, rectangles, or other shapes also as is well-known in the art. A foraminated electrode 48 termed an aperture mask is employed for color selection.

An electron gun 50 is disposed within neck 36 substantially as shown. Electron gun 50 is installed in axial alignment with a center line X—X of picture tube 34. Electron gun 50 is shown as being the type that emits three electron beams 52, 54 and 56 which selectively excite the pattern of target elements typified by elements 42, 44 and 46. Electron gun 50 may be of the unitized in-line type, or a gun of delta configuration.

Base 58 provides entrance means for a plurality of electrically conductive lead-in pins 60. Relatively low voltages in the range of 1–15 kilovolts provide for operation of the electron gun 50 of tube 34. The relatively high voltage; that is, a voltage typically in the range of twenty-four to thirty-two kilovolts provides for excitation of the screen and the final anode of the main focusing lens of gun 50. Lead 62 conducts the high voltage to anode button 64, which penetrates the funnel 38 to make contact with the inner conductive coating 66. The high voltage is conducted to the final focus electrode of gun 50 by snubber springs 68. A yoke 70 provides, in conjunction with ancillary circuits (not shown), deflection of beams 52, 54 and 56 for scanning faceplate 40.

FIG. 4A is a detailed view of the faceplate 40 of FIG. 4, showing additionally a film of aluminum 72 and black surround 74, components well-known in the picture tube art. Red-light-emitting target element 42, comprising a layer of phosphor, is shown as emitting light 76, indicated by the arrow, when excited by the "red" beam 52 emitted by electron gun 50.

Figure 5:
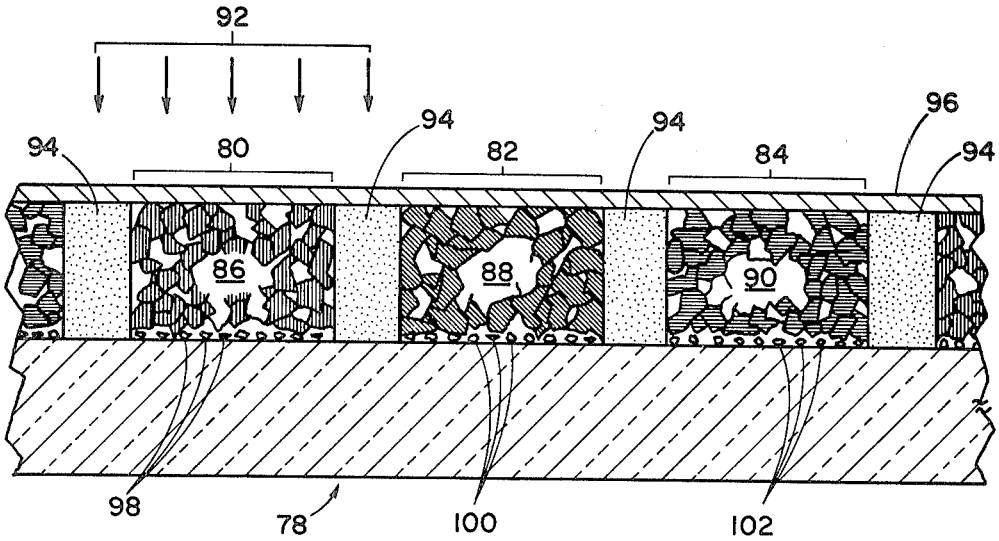
FIG. 5 is an enlarged schematic cross-sectional view of a fragment of a viewing screen comprising a preferred embodiment of the invention.

FIG. 5 is an enlarged cross-sectional, representational view of a fragment of a faceplate and viewing screen comprising a deeply-filtered image display representing a preferred embodiment of the invention. The screen shown may comprise a part of a three-beam color cathode ray tube of the aperture mask type. A faceplate 78 has a pattern of target elements deposited contiguous to its surface. The fragment of the faceplate shown is an illustration of one triad comprising target elements 80, 82 and 84. Each target element is assigned a layer of one of three kinds of phosphors 86, 88 and 90 which emit, when excited, red, green and blue light, respectively. Means for selectively exciting the phosphors is provided by energy source 92, indicated schematically by the bracketed arrows, and shown as impinging upon target element 80. The excitation source may comprise an electron beam which is caused to scan the target elements. Light-absorbing areas 94 are shown as being interspersed between the phosphor layers; these areas constitute the black surround well-known in the art. An electron-permeable film 96 reflects light emitted by the phosphor toward the viewer; film 96 may comprise a very thin layer of aluminum.

The improvement according to the invention comprises a shallow, random, clumped, discontinuous, open dispersion of contrast-enhancing particles of pigment 98, 100 and 102, which are shown as being associated with target elements 80, 82 and 84, respectively. Particles of pigment 98, 100 and 102, are preferably, two or more orders of magnitude smaller in volume than the associated phosphor particles indicated by 86, 88 and 90. The particles of pigment are disposed directly on faceplate 78 beneath the associated layer of phosphor particles and are not significantly admixed with the phosphor particles. Particles of pigment 98, 100 and 102 have a body color corresponding generally to the color of light emitted by the associated phosphor layer. For example, a dispersion of particles of pigment 98 have a body color corresponding to the color of the light emitted by the layer of phosphor 86 shown by graphic symbology as being red-light-emitting.

The "body color" of the contrast-enhancing particles of pigment comprises the intrinsic hue of the pigment in reflected ambient light. In the context of this disclosure, body color is in contradistinction to the color of the light emitted by the associated phosphor when excited, termed "image light." Thus the discontinuous open dispersion of contrast-enhancing particles of pigments 98, 100 and 102 have a body color corresponding generally to the color of the light emitted by the associated phosphor layers 86, 88 and 90, indicated by graphic symbology as red-, green-, and blue-light-emitting phosphors.

As a result of the means according to the invention, reflection of ambient light is lowered to a deep-filtration range of 35% to 50% relative to the body color of the associated phosphor taken as unity.

Figure 5A:
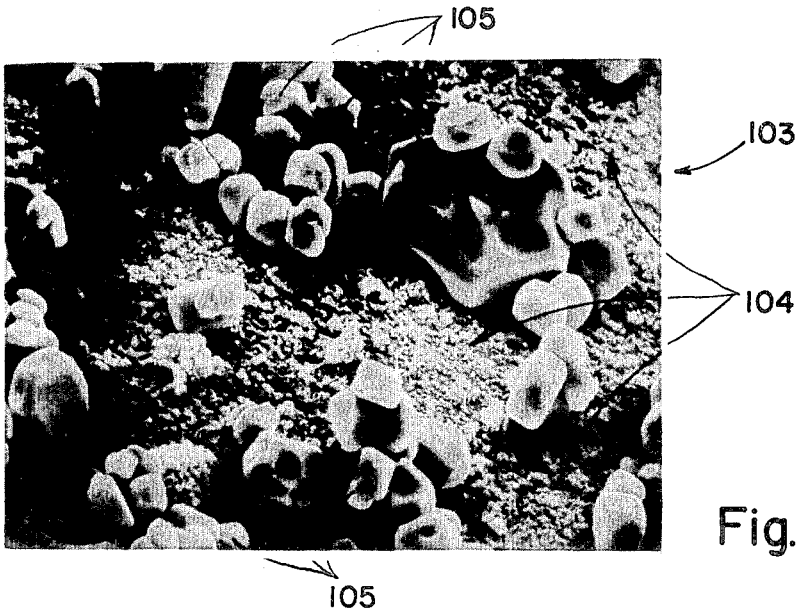
FIGS. 5A and 5B are copies of scanning electron microphotographs of 1700X and 3700X magnification respectively, showing an open dispersion of pigment particles according to the invention.
Figure 5B:
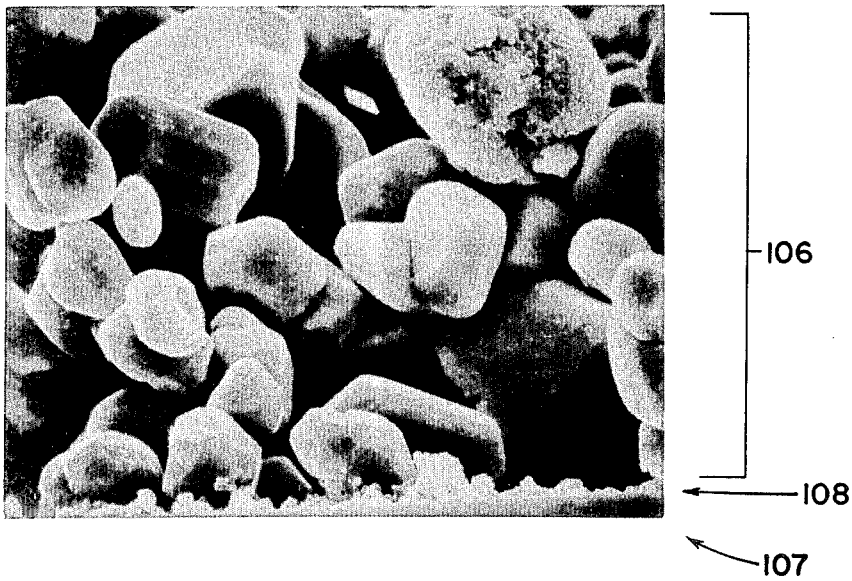
Figure 5C:
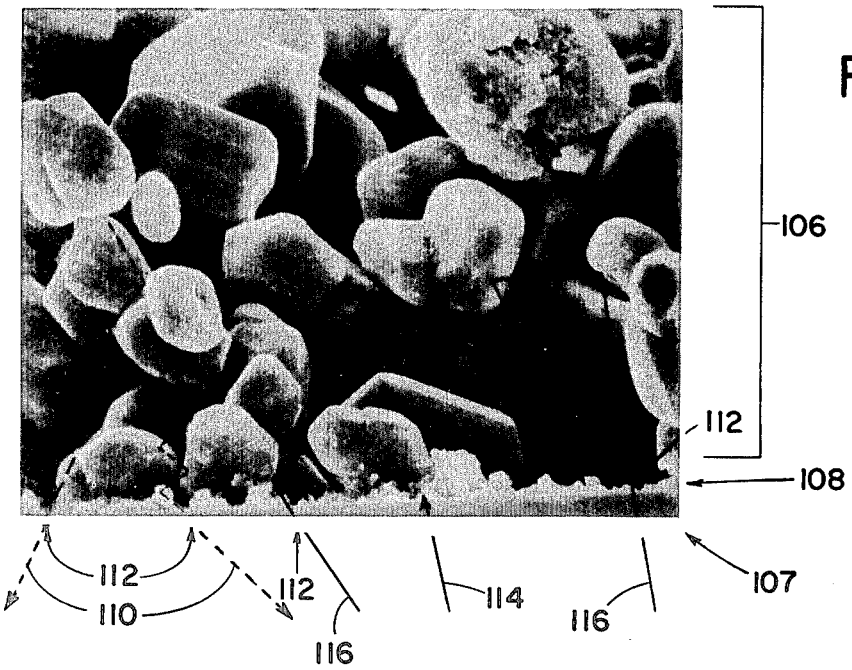
FIG. 5C is a low-contrast copy print of FIG. 5B in which deep filtering means according to the invention is illustrated diagrammatically.

A realization of the invention is shown by FIGS. 5A, 5B and 5C, which comprise scanning electron microscope photographs of the arrangement and relationship of phosphor particles and particles of pigment according to the invention, as deposited on a glass slide substrate in simulation of the glass of the cathode ray tube faceplate. (The particles of pigment shown are those having a red body color.)

FIG. 5A is an oblique plan view of a substrate 103 and a shallow, random, clumped, discontinuous, open dispersion of contrast-enhancing particles of pigment 104 located directly on the substrate 103 according to the invention. The particles of pigment 104 are located on the faceplate beneath a layer of phosphor particles 105; in FIG. 5A, most of the phosphor particles 105 have been removed to clearly reveal the open dispersion of particles of pigment 104. It will be seen that the individual particles of pigment 104, shown as being clumped, are preferably two or more orders of magnitude smaller in volume than the phosphor particle 105. It is observable also from FIG. 5A (as it is in 5B and 5C) that the particles of pigment 104 are not significantly admixed with phosphor particles 105.

FIG. 5B comprises a scanning electron microscope photograph of a section of a glass slide fractured to display in cross-section the arrangement and relationship of phosphor particles and particles in pigment according to the invention. A layer of phosphor particles 106 is shown as being disposed contiguous to a glass slide substrate 107, representing the picture tube faceplate. The phosphor particles when excited emit light of a predetermined color. The random, clumped, discontinuous, open dispersion of contrast-enhancing particles of pigment 108 according to the invention is indicated by the arrow; the particles of pigment 108 have a body color corresponding generally to the aforesaid predetermined color and are located directly on the faceplate beneath layer of phosphor particles 106 but not significantly admixed with layer 106.

FIG. 5C comprises a low-contrast print copy of FIG. 5B which more clearly shows the benefits of the invention with regard to the effect on ambient light and image light. The dash-line arrows represent light emitted by the particles of phosphor 108, and the solid-line arrows represent ambient light falling upon the glass substrate 107, representing the faceplate.

Light of the predetermined color emitted by the phosphor, or image light shown by arrows 110, "sees" effective light reflectors and scatterers and eventually finds its way out to the viewer through the openings 112 in the dispersion of pigment particles. These light reflectors and scatterers comprise, in addition to the phosphor particles, the particles of pigment themselves which are reflective of image light of the predetermined color of the associated phosphor. Ambient "white" light (with the exception of the blue complement), "sees" an open dispersion of particles of pigment which effectively absorbs the ambient light rays upon contact and prevents the re-emergence from openings 112 of ambient light which may pass into the phosphor layer through the openings 112 in the dispersion. The direct absorption of red and green ambient light by particles of pigment is indicated by arrow 114. The absorption of red and green rays of ambient light that find their way through ones of openings 112 is indicated by arrows 116.

Figure 6A:
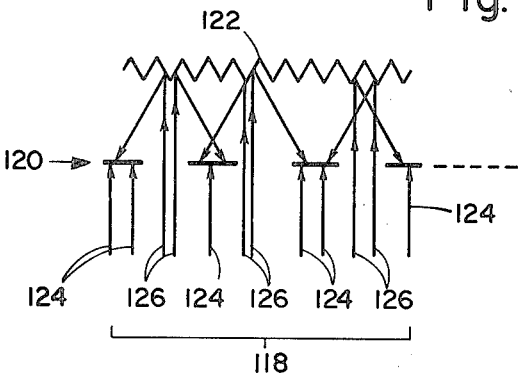
FIGS. 6A and 6B are diagrams indicating in greater detail the means for deep filtering according to the invention.
Figure 6B:
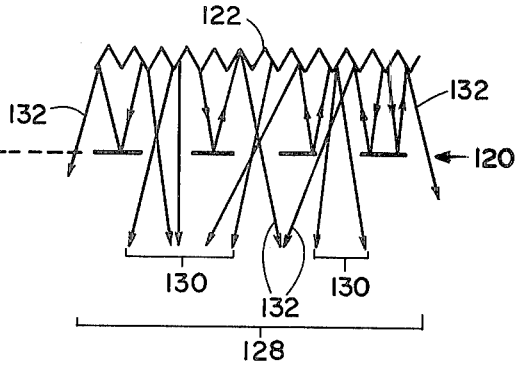

FIGS. 6A and 6B show diagrammatically the action of the means according to the invention for deep filtration of ambient light without a disproportionately countervailing loss in picture brightness. In FIG. 6A, rays 118 indicated by the bracket, representing only the red and green complements of incident white light, are shown by arrows as falling upon the highly schematic representation of the random, clumped, discontinuous, open dispersion of particles of pigment 120 according to the invention shown schematically by the dash line as a layer; in this example, the body color of the particles of pigment 120 should be considered as being blue. The front surface of a layer of phosphor particles emitting, when excited, blue light, is indicated by irregular line 122 in FIGS. 6A and 6B. Rays 124 of directly incident light having red and green complements are shown as being intercepted by the open dispersion 120 of particles of pigment and being absorbed. Rays 126 of directly incident light are shown as passing through the openings in the dispersion 120 and being scattered back off the phosphor particles to the dispersion 120 of pigment particles where the rays are intercepted and a second absorption occurs, as indicated. Assume that the percentage of open area of the dispersion causes an area-associated transmission factor of A; the total absorption factor, very roughly, is $A_2$ e.g., if A is 0.3 (absorption is 70%) then $A^2$ is 0.09 (absorption is about 90%).

FIG. 6B indicates schematically the effect of the open dispersion 120 of pigment particles according to the invention on rays of blue light 128, indicated by the bracket, emitted by phosphor layer 122. Rays 130 are shown as emerging directly through the openings in the dispersion 120 while other rays 132 are shown as reflecting between the particles of pigment and layer of phosphor particles 122 before finding their way out through openings in the dispersion 120 of pigment particles. The result is to provide high picture contrast without a disproportionately countervailing loss in picture brightness.

Prior art displays utilizing pigments for reduction of reflection of ambient light, such as those disclosed by Lipp and Ikegaki et al. (op. cit.) among others, provide for variously admixing particles of pigment with phosphor particles. The benefits of disposing a random, clumped, discontinuous, open dispersion of contrast-enhancing particles of pigment directly on the faceplate beneath the phosphor layer but not significantly admixed with the phosphor particles according to the invention include the following:

1. Ambient light "sees" the pigment particles first, and a substantial amount of the ambient light is absorbed before it reaches the associated phosphor particles. In contrast, in the prior art systems described heretofore, a large proportion of the pigment particles are inaccessible to ambient light and perform little or none of the desired reflectivity reduction.
2. By disposing the contrast-enhancing particles of pigment directly on the faceplate between the phosphor layer but not significantly admixed with the layer according to the invention, it is possible to use a greater ratio of pigment particles to phosphor particles without a disproportionately countervailing loss in picture brightness. When the pigment particles are admixed with the phosphor particles according to the cited prior art examples, if the ratio of pigment-to-phosphor is too great, the resulting brightness loss severely limits the light-emitting capabilities of the phosphor. The means according to the invention permits larger amounts of pigments to be used which contributes substantially to the achievement of deep filtration of ambient light.
3. The energy of the phosphor-exciting source; e.g., the electron beam in a cathode ray tube image display, is relatively unaffected by the open dispersion of pigment particles according to the invention because the particles are located on the side of the phosphor particles opposite the beam, so absorption of beam energy is negligible. In the admixed pigment phosphor systems of the prior art, however, a substantial proportion of the pigment particles will be located between the phosphor particles and the electron beam to absorb an appreciable amount of energy of the beam, resulting in reduced brightness of the image.

A practical way to determine the effectiveness of the means according to the invention in providing deep filtraton of ambient light is expediently accomplished by preparing a two-inch by three-inch slide, with half of the slide coated with pigment particles in the open dispersion according to the invention. The entire slide is then coated with phosphor particles of interest, after which the phosphor is coated with a thin film of aluminum by means well-known in the art. The light reflected by each of the two areas, as viewed through the glass of the slide, under ambient light is compared using a standard reflectometer.

The relative brightness can be determined by the well-known means wherein the aforesaid slide is installed in an air-evacuated chamber and illuminated from the aluminized side with an electron beam having an energy of known magnitude. The relative brightness of the pigmented and unpigmented areas is then determined by means of a precision light meter. Concurrently, the color coordinates are measured to determine the degree of color saturation.

Figure 7:
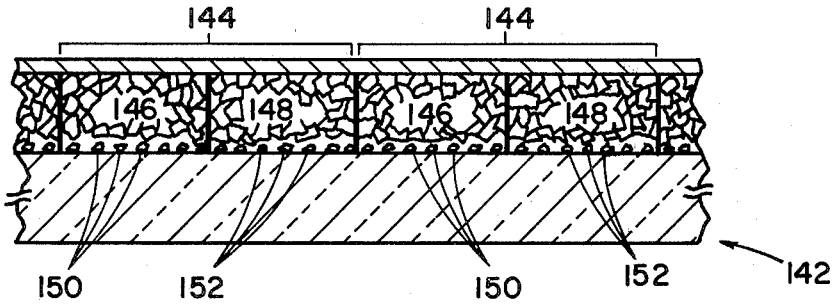
FIG. 7 is an enlarged schematic cross-sectional view of a fragment of a faceplate showing another embodiment of the invention.

Another embodiment of the invention is the application of the inventive concept to an image display having a viewing faceplate for exhibiting a diatonal achromatic image subject to loss of contrast by reflection of ambient light from the faceplate. A fragment of the faceplate of this type is shown in cross-section in FIG. 7. Faceplate 142 is shown as having disposed contiguous to its inner surface a pattern of pairs 144 of spaced target elements, indicated by the brackets. Each element of each pair 144 is assigned one of two types of phosphor emitting, when excited, blue or yellow light. For example, the blue-light-emitting phosphor is indicated by reference number 146, and the yellow-light-emitting phosphor is indicated by reference number 148. The combined light emission of the pairs 144 when excited, produce the desired diatonal achromaic image. The eye of the viewer perceives this microstructure as an image exhibiting various gray tones.

An improvement according to the invention comprises a random, clumped, discontinuous, open dispersion of contrast-enhancing particles of pigment 150 and 152 preferably two or more orders of magnitude smaller in volume than the associated phosphor particles. The particles of pigment 150 and 152 are located directly on faceplate 142 beneath phosphor layers 146 and 148, respectively, but not significantly admixed with the phosphor particles. The percentage of open area of the dispersion of pigment particles 100 and 152 and the absorption characteristics thereof are such that the dispersion efficiently filters ambient light at the interface with the layers of phosphor particles 146 and 148. Thus, efficient filtration is accomplished first by absorption of directly incident ambient light, and second, by absorption of ambient light passing through the open dispersion and scattering back off the phosphor particles to the dispersion. The dispersion represents a tolerable impediment to image light emitted by the phosphor particles due to the shallowness and openness of the dispersion and its non-absorption of light of the respective associated phosphor particles. The dispersion also negligibly absorbs electron beam energy due to its location beneath the layer. As a result, deep filtration of ambient light is made practicable and thus high picture contrast is achieved without a disproportionately countervailing loss in picture brightness.

With regard to relative dimensions, the layers of phosphor may have a thickness of about 40 to 60 microns, for example. The particles of pigment may have a thickness of about 1 to 5 microns depending largely on the particle size of the particular pigment, whether red, green or blue. These dimensions and other measurements and values set forth herein are not intended to be limiting, but exemplary only.

Examples of pigments which may be used according to the invention comprise extremely fine inorganic particulates which are commercially available. For example, a suitable red pigment may comprise cadmium sulfoselenide (Cd-S-Se) having a particle size of about 0.5 micron. A suitable pigment of this composition is Cadmium Medium Light Red No. 2010 supplied by General Color Company, Newark, N.J. Another red pigment is iron oxide. A blue pigment may comprise cobalt aluminate such as Harshaw No. 7546 supplied by Harshaw Chemical Co., Cleveland, Ohio. Another suitable blue pigment supplied by Harshaw is designated Meteor Cobalt Blue R, No. 7536, and comprises cobalt silica zinc.

It should be noted that at present, only red and blue pigments are utilizable because an acceptable green pigment is not available. As presently constituted, green pigments absorb too much of the light output of the associated phosphor. However, if perchance the use of a green contrast-enhancing pigment is desired in association with a green-light-emitting phosphor, a modified chromic oxide may be used.

The random, clumped discontinuous open dispersion of contrast-enhancing particles of pigment located directly on the faceplate according to the invention may be applied by any of a number of well-known schemes such as slurrying, settling, or electrodeposition. The slurry process will be described as exemplary.

It is to be noted that the slurry process of application is so well-known in the art that it was deemed unnecessary to provide all the details of the process other than those directly relevant to pigment application.

A suitable formula for a slurry comprising particles of pigment having a body color of blue is as follows Meteor Cobalt Blue Pigment. Harshaw No. 7536; 50 grams.

Polyvinyl alcohol, 10% concentration in water; 150 grams.

Deionized water: 100 milliliters.

The components are mixed and ball-milled for at least one hour to obtain a dispersed suspension free of aggregates. To the ball-milled suspension is added 500 milliliters of deionized water and 5 milliliters of ammonium dichromate, 10% solution. The slurry is poured over a horizontally oriented faceplate which is, for example, of 13-inch diagonal measure. The faceplate is tilted to a vertical orientation and rotated at about 200 rpm until dry. The areas where the particles of pigment are to be permanently fixed are subject to ultraviolet light directed to the screen through an associated aperture mask. The faceplate is then "developed" to remove the particles of pigment from all other elemental areas of the faceplate except those which have been exposed. A similar slurry process is used for depositing the blue phosphor, which for example may be P22, directly on the elemental areas of the faceplate having a deposit of the blue pigment particles. The process is then repeated for pigments and associated phosphors of other colors as desired. The final process comprises aluminizing the faceplate by means well-known in the art.

The reflectivity of a blue-light-emitting phosphor, for example, pigmented according to the invention, as compared to an unpigmented "blue" phosphor, is about 0.25 (the unpigmented phosphor being taken as 1.0).

The order of deposition is optional. It may be determined that it is preferable, for example, to deposit the red pigment and associated phosphor first; alternatively, both the red and blue pigments could as well be deposited initially, followed by the respective phosphors.

The formula for a slurry containing a pigment for deposit in association with and having a body color corresponding generally of a red-light-emitting phosphor, for example, is very similar to the formula described supra for the blue pigment slurry. Considerable latitude consists in pigment slurry formulations; quantities of pigments required are dependent upon the desired amount of filtration desired, and the exact formulations can be determined without undue experimentation by one having ordinary skill in the art. As noted, layers of particles of pigment are preferably applied in association with only the red- and blue-light-emitting phosphors, as an acceptable green colorant is considered as not being presently available.

The effectiveness of the means according to the invention in making practicable deep filtration of ambient light and thus high picture contrast without a disproportionately countervailing loss in picture brightness is shown by the results of laboratory tests described as follows. A control base-line was established by averaging the white field (7500° K.) brightness and reflectivity (absolute) characteristics of standard production-line 25-inch striped-screen black matrix picture tubes. The brightness and reflectivity characteristics of a test picture tube similar in respect to the control tubes, except that the faceplate was red- and blue- pigmented by the means according to the invention, was measured, with the following results

| | Control | Pigmented Tube |
|---|---|---|
| Brightness, fL | 80 | 68 |
| Reflectivity | 0.50 | 0.261 |

Accordingly, the actual reduction in the reflection of ambient light of the pigmented tube is about 48%, with a brightness loss of 15%. If the pigmenting according to the invention was such as to provide a reduction in reflection of 40%, for example (well within the range defined as "deep filter"), the resulting brightness loss would be about 9%. This loss could conceivably be further reduced by, for example, the use of more efficient combinations of pigments and phosphors.

While particular embodiments of the invention have been shown and described, it will be obvious to those skilled in the art that changes and modifications may be made without departing from the invention in its broader aspects, and therefore the aim in the appended claims is to cover all such changes and modifications as fall within the true spirit and scope of the invention.

I claim:

1. In a low cost, deeply filtered image display having a faceplate with a viewing screen including a patterned layer of phosphor particles disposed contiguous to an inner surface thereof which, when excited emits light of a predetermined color, and having means for exciting selected areas of said layer to produce a luminescent informational image, said image being subject to loss of contrast caused by reflection of ambient light from said layer, an improvement comprising a shallow, random, clumped, discontinuous, open dispersion of contrast-enhancing particles of pigment having a body color corresponding generally to said predetermined color located directly on said faceplate beneath said layer and not significantly admixed with said phosphor particles, the percentage of open area of said dispersion of pigment particles and the absorption characteristics thereof being such that said dispersion efficiently filters ambient light at its interface with said layer, first by absorption of directly incident ambient light, and second by absorption of ambient light passing through said open dispersion and scattering back off said phosphor particles to said dispersion, said dispersion representing a tolerable impediment to image light emitted by said phosphor particles due to the shallowness and openness of said dispersion and its non-absorption of light of said predetermined color, said dispersion negligibly absorbing electron beam energy due to its location beneath said layer, making practicable deep filtration of ambient light and thus high picture contrast without a disproportionately countervailing loss in picture brightness.

2. The image display defined in claim 1 wherein said reflection of ambient light is lowered to a deep filtration range of 35% to 50% relative to the body color of the phosphor taken as unity.

3. The image display defined by claim 1 wherein said particles of pigment are selected from a group consisting of cadmium sulfoselenide, iron oxide, cobalt aluminate, cobalt silica zinc and chromic oxide.

4. A low-cost, deeply filtered television image display comprising a multi-color cathode ray picture tube of the aperture-mask type, said tube having a three-beam electron gun, a color selection aperture mask, and a faceplate with a viewing screen including a pattern of triads of target elements deposited contiguous thereto, each target element of each triad having assigned a layer of one of three kinds of phosphor particles emitting, when excited, red, green or blue light, and means for selectively exciting ones of said target elements to produce a luminous informational image, said image being subject to loss of contrast caused by reflection of ambient light from said layers, an improvement comprising a shallow, random, clumped, discontinuous open dispersion of contrast-enhancing particles of pigment two or more orders of magnitude smaller in volume than said phosphor particles associated with each of at least two of said target elements constituting said triads and having a body color corresponding generally to the color of the light emitted by the associated phosphor layer located directly on said faceplate beneath said phosphor layer and not significantly admixed with said phosphor particles, the percentage of open area of said dispersion of pigment particles and the absorption characteristics thereof being such that said dispersion efficiently filters ambient light at its interface with said layer, first by absorption of directly incident ambient light, and second by absorption of ambient light passing through said open dispersion and scattering back off said phosphor particles to said dispersion, said dispersion representing a tolerable impediment to image light emitted by said phosphor particles due to the shallowness and openness of said dispersion and its non-absorption of light of the color emitted by the associated phosphor layer, said dispersion negligibly absorbing electron beam energy due to its location beneath said layer, making practicable deep filtration of ambient light and thus high picture contrast without a disproportionately countervailing loss in picture brightness.

5. A low-cost, deeply filtered television image display comprising a multi-color cathode ray picture tube of the aperture-mask type, said tube having a three-beam electron gun, a color selection aperture mask, and a faceplate with a viewing screen including a pattern of triads of target elements deposited contiguous to an inner surface thereof, each target element of each triad having assigned a layer of one of three kinds of phosphor particles emitting, when excited, red, green or blue light, and means for selectively exciting ones of said target elements to produce a luminous informational image, said image being subject to loss of contrast caused by reflection of ambient light from said layers, an improvement comprising a random, clumped, discontinuous, open dispersion of contrast-enhancing particles of pigment two or more orders of magnitude smaller in volume than said phosphor particles associated with those target elements having phosphor layers emitting either red or blue light, said particles of pigment having a body color corresponding generally to the color of the light emitted by the associated phosphor layer located directly on said faceplate beneath said layer but not significantly admixed with said layer, the percentage of open area of said dispersion of pigment particles and the absorption characteristics thereof being such that said dispersion efficiently filters ambient light at its interface with said layer, first by absorption of directly incident ambient light, and second by absorption of ambient light passing through said open dispersion and scattering back off said phosphor particles to said dispersion, said dispersion representing a tolerable impediment to image light emitted by said phosphor particles due to the shallowness and openness of said dispersion and its non-absorption of light of the color emitted by the associated phosphor layer, said dispersion negligibly absorbing electron beam energy due to its location beneath said layer, making practicable deep filtration of ambient light and thus high picture contrast without a disproportionately countervailing loss in picture brightness.

6. In a low cost, deeply filtered television image display having a faceplate with a viewing screen including a patterned layer of phosphor particles disposed contiguous to an inner surface thereof which, when excited emits light of a predetermined color, and having means for exciting selected areas of said layer to produce a luminescent informational image, said image being subject to loss of contrast caused by reflection of ambient light from said layer, an improvement comprising a shallow, random, clumped, discontinuous, open dispersion of contrast-enhancing particles of pigment two or more orders of magnitude smaller in volume than said phosphor particles, said particles of pigment having a body color corresponding generally to said predetermined color located directly on said faceplate beneath said layer and not significantly admixed with said phosphor particles, the percentage of open area of said dispersion of pigment particles and the absorption characteristics thereof being such that said dispersion efficiently filters ambient light at its interface with said layer, first by absorption of directly incident ambient light, and second by absorption of ambient light passing through said open dispersion and scattering back off said phosphor particles to said dispersion, said dispersion representing a tolerable impediment to image light emitted by said phosphor particles due to the shallowness and openness of said dispersion and its non-absorption of light of said predetermined color, said dispersion negligibly absorbing electron beam energy due to its location beneath said layer, making practicable deep filtraton of ambient light and thus high picture contrast without a disproportionately countervailing loss in picture brightness, and wherein said reflection of ambient light is lowered to a deep-filtration range of 35% to 50% relative to the body color said phosphor taken as unity.

7. In a low cost, deeply filtered television image display having a faceplate with a viewing screen including a patterned layer of phosphor particles disposed contiguous to an inner surface thereof which, when excited emits light of a predetermined color, and having means for exciting selected areas of said layer to produce a luminescent informational image, said image being subject to loss of contrast caused by reflection of ambient light from said layer, an improvement comprising a shallow, random, clumped, discontinuous, open dispersion of contrast-enhancing particles of pigment two or more orders of magnitude smaller in volume than said phosphor particles, said particles of pigment having a body color corresponding generally to said predetermined color located directly on said faceplate beneath said layer and not significantly admixed with said phosphor particles, the percentage of open area of said dispersion of pigment particles and the absorption characteristics thereof being such that said dispersion efficiently filters ambient light at its interface with said layer, first by absorption of directly incident ambient light, and second by absorption of ambient light passing through said open dispersion and scattering back off said phosphor particles to said dispersion, said dispersion representing a tolerable impediment to image light emitted by said phosphor particles due to the shallowness and openness of said dispersion and its non-absorption of light of said predetermined color, said dispersion negligibly absorbing electron beam energy due to its location beneath said layer, making practicable deep filtration of ambient light and thus high picture contrast without a disproportionately countervailing loss in picture brightness, and wherein said particles of pigment are selected from a group consisting of cadmium sulfoselenide, iron oxide, cobalt aluminate, cobalt silica zinc, and chromic oxide.

8. A low cost, deeply filtered image display for exhibiting a diatonal achromatic image, said display having a faceplate with a viewing screen including a layer of phosphor particles comprising pairs of spaced target elements disposed contiguous to the inner surface of said faceplate, each element of each pair being assigned one of two types of phosphors emitting, when excited, blue or yellow light, the combined emissions of said pairs producing said diatonal achromatic image, an improvement comprising a random, clumped, discontinuous, open dispersion of contrast-enhancing particles of pigment two or more orders of magnitude smaller in volume than said phosphor particles, said particles of pigment having a body color corresponding generally to the light emitted by the associated phosphor, said particles of pigment being located directly on the faceplate beneath said layer of phosphor and not significantly admixed with said phosphor particles, the percentage of open area of said dispersion of pigment particles and the absorption characteristics thereof being such that said dispersion efficiently filters ambient light at its interface with said layer, first by absorption of directly incident ambient light, and second by absorption of ambient light passing through said open dispersion and scattering back off said phosphor particles to said dispersion, said dispersion representing a tolerable impediment to image light emitted by said phosphor particles due to the shallowness and openness of said dispersion and its non-absorption of light of the respective associated phosphor particles, said dispersion negligibly absorbing electron beam energy due to its location beneath said layer, making practicable deep filtration of ambient light and thus high picture contrast without a disproportionately countervailing loss in picture brightness.

* * * * *